US006764347B1

(12) United States Patent
Plishner

(10) Patent No.: US 6,764,347 B1
(45) Date of Patent: Jul. 20, 2004

(54) PLUG AND SOCKET HOLDER FOR REPLACEABLY HOLDING DIODE-BASED LIGHT SOURCES AND OTHER RADIATION SOURCES AND RECEIVERS

(75) Inventor: Paul J. Plishner, 42 Foster Crossing, Southampton, NY (US) 11968

(73) Assignee: Paul J. Plishner, Southampton, NY (US)

( * ) Notice: Subject to any disclaimer, the term of this patent is extended or adjusted under 35 U.S.C. 154(b) by 0 days.

(21) Appl. No.: 10/345,077

(22) Filed: Jan. 15, 2003

Related U.S. Application Data

(60) Provisional application No. 60/438,206, filed on Jan. 6, 2003.

(51) Int. Cl.[7] ..... H01R 24/04
(52) U.S. Cl. ..... 439/668; 439/669; 439/490
(58) Field of Search ..... 439/668, 669, 439/490, 488

(56) References Cited

U.S. PATENT DOCUMENTS

| | | | | |
|---|---|---|---|---|
| 3,154,360 A | | 10/1964 | Plishner | |
| 5,062,807 A | * | 11/1991 | Guss, III | 439/490 |
| 5,554,049 A | * | 9/1996 | Reynolds | 439/490 |
| 5,593,323 A | * | 1/1997 | Dernehl | 439/668 |
| 5,690,509 A | * | 11/1997 | Eisenbraun | 439/490 |
| 5,912,804 A | | 6/1999 | Lawson et al. | |
| 5,964,616 A | * | 10/1999 | Eisenbraun | 439/490 |
| 6,120,312 A | | 9/2000 | Shu | |
| 6,254,423 B1 | | 7/2001 | Lin | |
| 6,259,170 B1 | * | 7/2001 | Limoge et al. | 307/10.8 |
| 6,268,702 B1 | | 7/2001 | Fleck | |
| 6,416,334 B1 | | 7/2002 | Plishner | |
| 6,572,402 B2 | * | 6/2003 | Lin | 439/490 |
| 6,595,792 B1 | * | 7/2003 | Rudolph et al. | 439/345 |

OTHER PUBLICATIONS

*Apple May Plan Computer Chameleon to Reflect Owners' Whims*, by John Markoff, The New York Times, Jan. 6, 2003.

* cited by examiner

*Primary Examiner*—Gary Paumen
(74) *Attorney, Agent, or Firm*—Ware, Fressola, Van Der Sluys & Adolphson LLP

(57) ABSTRACT

A holder (100) for holding typically a plurality of diodes (301 301' 301" 301'") each able to serve as a source or receiver of visible or invisible radiation, the holder (100) including a plug (10) and socket (11), with the socket (11) bearing the diodes (301 301' 301" 301'") and formed so as to have an elongated longitudinally extending cavity therein and so as to include a plurality of longitudinally spaced mutually insulated first contact elements (41) disposed within the cavity, and with the plug (10) slidably registering with the cavity between advanced and retracted positions and including a plurality of longitudinally spaced, mutually insulated second contact elements (20 21 83) disposed along its length and which are in engagement with the first contact elements (41) only when the plug (10) is in its advanced position and rotated relative to the socket (11).

20 Claims, 7 Drawing Sheets

PLUG AND SOCKET HOLDER FOR REPLACEABLY HOLDING DIODE-BASED LIGHT SOURCES AND OTHER RADIATION SOURCES AND RECEIVERS

CROSS REFERENCE TO RELATED APPLICATIONS

Reference is made to and priority claimed from U.S. provisional application Ser. No. 60/438,206 Jan. 6, 2003, using Express Mail No. EV 137 072 799 US, entitled, PLUG AND SOCKET HOLDER FOR REPLACEABLY HOLDING DIODE-BASED LIGHT SOURCES AND OTHER RADIATION SOURCES AND RECEIVERS.

The present invention is related to the following co-filed U.S. application:

Ser. No. 10/345,083, entitled CONNECTOR HAVING INTEGRATED CIRCUITS EMBEDDED IN THE CONNECTOR BODY FOR MAKING THE CONNECTOR A DYNAMIC COMPONENT OF AN ELECTRICAL SYSTEM HAVING SECTIONS CONNECTED BY THE CONNECTOR, filed Jan. 15, 2003, U.S. Express Mail No. EV 137 072 737 US.

The subject matter of the related application is hereby incorporated by reference in its entirety.

FIELD OF THE INVENTION

The present invention pertains to the fields of electrical devices, including lighting (as provided by lamps) and optical devices generally, such as lamps, LEDs, photocells, VCSELs (Vertical Cavity Surface Emitting Lasers), microwave diodes and laser diodes, and, more particularly, to holders for such diodes.

BACKGROUND OF THE INVENTION

With the continuing development of high-intensity, long-lived, high-efficiency light emitting diodes (LEDs), it is expected that incandescent and fluorescent lighting will eventually become obsolete. The development of gallium nitride (GaN) semiconductor material, which makes possible providing white light, and the continuing progress in manufacturing GaN in bulk are in combination the major impetus for growth in the light emitting diode industry.

Not only are LEDs expected to replace incandescent and fluorescent lights for general illumination, but diode-based sources of other kinds of radiation besides visible are expected to replace existing corresponding devices in the next decade. For example, laser diodes are expected to be used not only in low-power applications such as telecommunications as they are now, but also as high-power lasers, replacing other kinds of lasers now used in such applications as cladding, cutting, drilling, surface modification (heat treating, glazing, surface alloying), and welding. Moreover, diode-based lasers (semiconductor lasers) are being further developed; a new kind of such a laser is a VCSEL (Vertical Cavity Surface Emitting Laser), which is already having a dramatic influence in computing and networking, sensing, and other applications. Typical applications of VCSELs include: fiber optic data links, proximity sensors, encoders, laser range finders, laser printing, bar code scanning, and optical storage. In addition to the existing and anticipated uses of diodes as sources of radiation, diodes are currently of use not only as sources of radiation, but also as receivers, such as in detecting light so as to turn off or on an electrical device, i.e. for use in photocells.

With the apparently inevitable replacement of conventional lighting by LEDs and the further development and increasing use of diodes as sources and receivers for all kinds of radiation, what is needed is a holder, i.e. a plug and socket, for such diodes, ideally a holder that allows control over an assembly of such diodes so as to be able to, for example, vary the intensity of light produced by such diodes, or vary the color of the light (by connecting or disconnecting from a circuit diodes providing different colors of light that in combination yield the desired color).

SUMMARY OP THE INVENTION

Accordingly, the present invention provides a holder comprising a plug and socket, wherein the socket includes a diode able to serve as a source or receiver of visible or invisible radiation, wherein the socket has an elongated longitudinally extending cavity formed therein as the inner surface of a shell and includes a plurality of longitudinally spaced mutually insulated first contact elements disposed within said cavity, wherein the plug slidably registers with said cavity between advanced and retracted positions and has a leading end directed toward the base of said cavity, wherein the plug includes a plurality of longitudinally spaced, mutually insulated second contact elements disposed along said plug, and wherein the holder includes means maintaining a predetermined angular orientation between said plug and socket during relative sliding thereof and permitting relative rotation thereof at said plug advanced position, said first contact elements and second contact elements being out of engagement at said predetermined angular orientation and in engagement upon rotation in a single predetermined sense from said predetermined angular orientation to a closed contact position.

In accord with the first aspect of the invention, the diode may be for example a light-emitting diode (LED), or it may be a laser diode, or it may be a photocell diode, or it may be a microwave diode et al.

Also in accord with the first aspect of the invention, the holder may include a controller for controlling current to the diode. Further, the controller may be a resistor or may be an integrated circuit, or may control a switchable bank of resistors. Also further, the socket may include a plurality of diodes, and the controller may control a plurality of banks of resistors, each for limiting current to a respective diode or a series/parallel array of diodes. Also further, the diode may be provided as a series/parallel array of individual diodes; such an array may be either a two-dimensional array or a three-dimensional array, and may be either a purely series array or a purely parallel array or a series/parallel array, and, in addition, the output of the individual diodes may be in phased relation, with the array using for the individual diodes either diode sources or diode receivers of radiation.

Also in accord with the first aspect of the invention, the holder may include a plurality of longitudinally aligned sets of the longitudinally spaced second contact elements and a corresponding plurality of longitudinally aligned sets of the first longitudinally spaced contact elements, and the peripheries of the sets of second contact elements may be of arcuate configuration extending circumferentially about the plug for less than 360° and in a straight line, lengthwise of the holder.

Also in accord with the first aspect of the invention, the socket may include a well portion defined by a cylindrical wall, the inner surface thereof having longitudinally spaced recesses formed therein, the first contact elements being located in the recesses and normally projecting above the upper edges thereof and being resiliently inwardly urged by the second contact elements during engagement therewith, and including lugs connected to the first contact elements and projecting through said cylindrical wall.

Also in accord with the first aspect of the invention, the orienting means may be defined by at least one longitudinally extending groove formed in one of the holder members and at least one slidably engaging protuberance mounted on the other of the members.

Still also in accord with the first aspect of the invention, the plug and socket may each include in a respective longitudinally extending center cavity an end of at least one conductor adapted for conveying high frequency and other signals and means for connecting the ends. Further, the conductor adapted for conveying the high frequency signals in the socket may be terminated in an integrated circuit embedded in the socket. Also further, the conductor adapted for conveying the high frequency signals in the socket may be terminated in at least one of the diodes held by the socket.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

Figure 1:
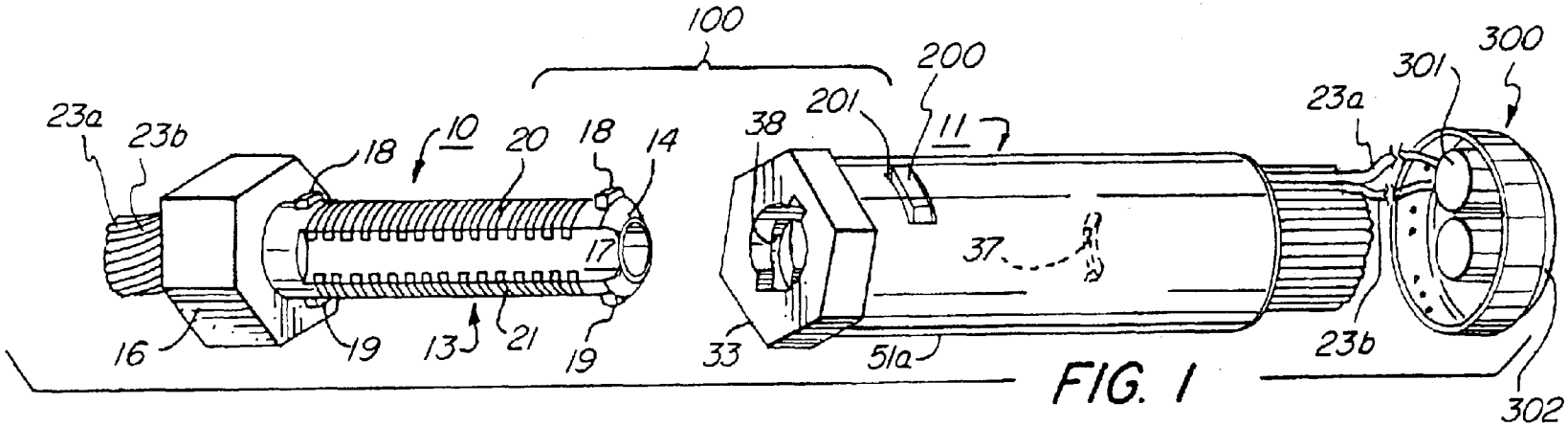
FIG. 1 is a perspective view of an LED holder according to the invention, including a plug section and a socket section, and illustrated in uncoupled condition.
Figure 2:
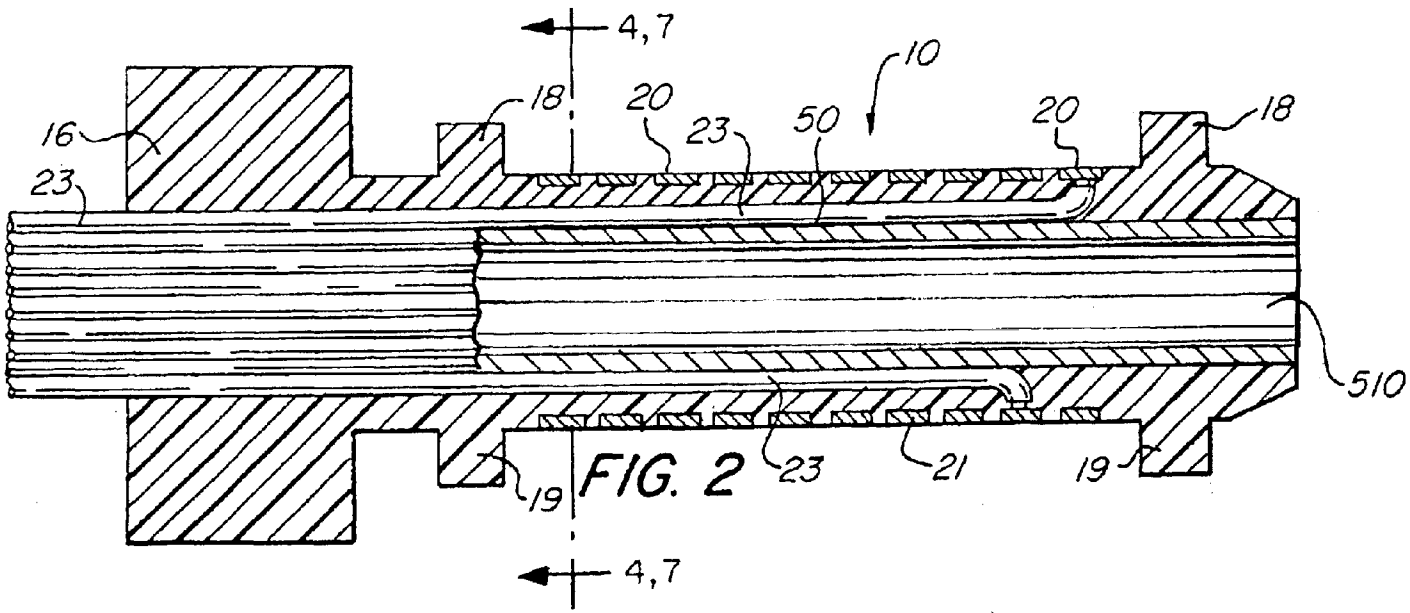
FIG. 2 is a medial longitudinal sectional view of the plug section.
Figure 4:
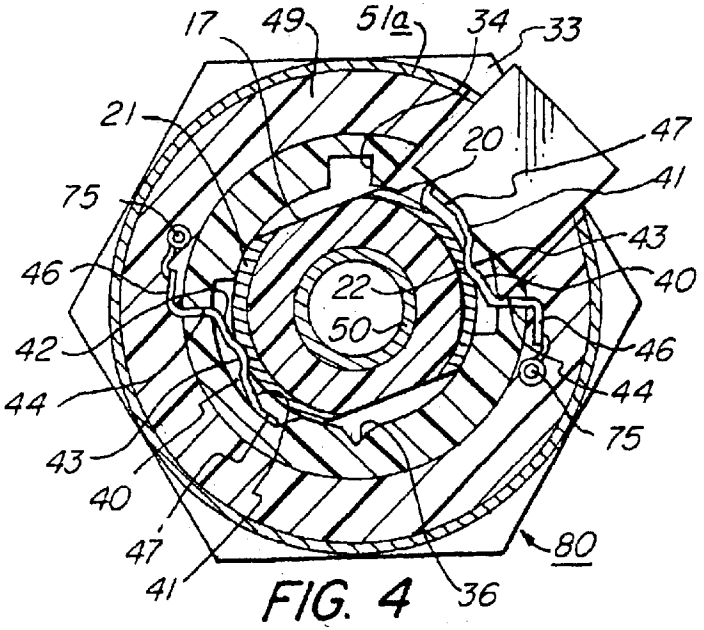
FIG. 4 is a sectional view taken along line 4—4 in FIG. 3.
Figure 3:
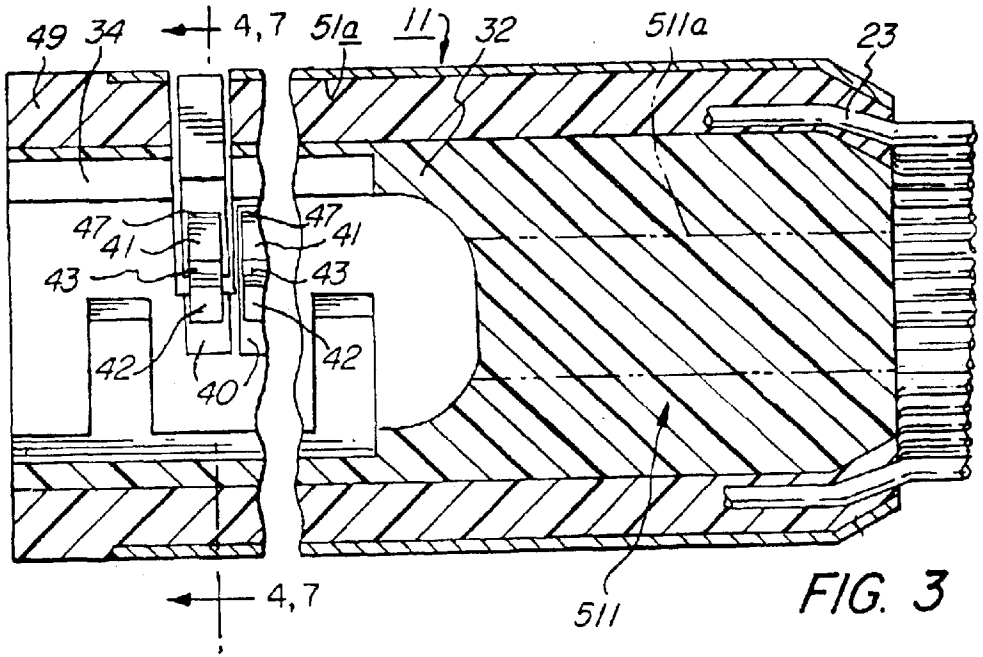
FIG. 3 is a fragmentary medial longitudinal sectional view of the socket section.

The invention will now be described as an elongated holder (plug and socket) for an array of LEDs (light emitting diodes) in a preferred embodiment in which connections for the LEDs, including connections to a controller embedded in the holder, are arranged along the length of the elongated holder, so as to save space compared to arrangements in which such connections are arranged in a plane perpendicular to the longitudinal axis. The invention should, however, be understood to encompass both kinds of arrangements, and should also be understood not to be limited to holders for LEDs, but to encompass holders for diode-based radiation transmitters/sources and receivers for all kinds of radiation, not only visible radiation. In the preferred embodiment, the socket also includes an embedded integrated circuit for performing various functions in respect to operation of the array of LEDs, but the invention is not limited to such a socket.

Referring now to the drawings, and more particularly to FIGS. 1 to 4, 7 and 8, a holder 100 is shown as including a plug 10 and a socket 11, with the socket 11 including a controller 200 provided as an integrated circuit (IC) embedded in the socket via an opening 201 of the casing of the socket 11, and with the socket 11 also including a diode bulb 300 comprising an array of LEDs 301 and a lens 302, with each LED 301 connected to a respective feed 23*a* and return 23*b* connected to a power source (not shown) through corresponding conductors 23*a* and 23*b* in the plug 10, as described below. The lens may be a compound lens, i.e. there may be a separate lens for each LED 301. The socket 11, consisting of the diode bulb 300 and the other components that in effect serve as the diode bulb terminal, is able to be unscrewed in the sense described below or unplugged, as is e.g. a so-called bayonet connection; thus, the diode bulb 300 can be unscrewed or unplugged and replaced (and then preferably recycled by replacing selected components), much as an incandescent light bulb is replaced.

The plug 10 and socket 11 composition of the holder look is intended to allow holding not only diodes, but any source or receiver of radiation, and doing so in a way that allows easy replacement of the socket-mounted sources or receivers. The holder is intended for replaceably holding any radiation source or receiver now in use or contemplated, and preferably a plurality of such radiation sources or receivers, including for example any source of general illumination, such as a lamp or an LED, and including for example photocells, VCSELs (Vertical Cavity Surface Emitting Lasers), microwave diodes and laser diodes. The arrangement of the plug 10 and socket 11 connections is especially advantageous in that it allows replaceably holding not only a plurality of the same kind of radiation sources or receivers, but also a plurality of different kinds of radiation sources or receivers, such as a plurality of LEDs along with a plurality of incandescent or fluorescent bulbs, and doing so compactly due to arranging connections between the socket 11 and plug 10 along the length of the elongated holder 100.

Plug 10 is formed of an insulating material such as thermoplastic or thermosetting resin and includes a longitudinally extending tubular shank 13 having a tapered frusto-conical leading-end 14 and provided at its trailing end with an enlarged head 16, which defines a finger manipulating piece. Shank 13 is of substantially circular transverse cross section and is provided with diametrically opposite longitudinally extending flat surfaces 17 extending from the tip 14 thereof to a point short of the head 16, flats 17 being closer to the axis of the shank 13 than the remaining arcuate peripheral surface thereof.

Located on one of the arcuate surfaces of shank 13 adjacent tip end 14 are a pair of longitudinally spaced upright projections 18 having substantially parallel side walls, the forward projection being immediately posterior to the leading end 14 of the shank 13 and the rear projection being just forward of plug head 16. On the opposite arcuate surface of the shank 13 there may be located longitudinally spaced prismatic projections 19 which are diametrically opposite to the respective projections 18.

A set of longitudinally spaced and longitudinally aligned arcuate metal contact elements 20 are embedded in shank 13 along one of the arcuate peripheral surfaces thereof. The.

contact elements 20 extend circumferentially for less than 180° and their outer surface is coplanar with the arcuate peripheral surface of the shank 13 and their edges coplanar with flats 17; Another set of longitudinally spaced, longitudinally aligned arcuate contact elements 21 are provided, laterally aligned with the first set, the outer surfaces of elements 21 being coplanar with the arcuate surface of shank 13, the end edges of corresponding pairs of contact elements 20 and 21 being laterally spaced from each other. Formed in the outer surface of each of the contact elements 20 21 intermediate the ends thereof is an arcuate recess 22.

Connected to each of contact elements 20 and 21 is an insulator covered conductor 23, which could be a feed 23*a* or a return 23*b* or one or another other conductor used in connection with the operation of the LED holder 100. The end of the conductor 23 is soldered to a corresponding contact element, the conductors 23 being disposed along the inner peripheral base of shank 13 and extending longitudinally through the trailing end thereof.

Housed in and coaxial with shank 13 is a tubular strength member 50, preferably made of metal but also advantageously made from a hard plastic, which projects through the leading end of the shank 13, the insulated conductor 23 being sandwiched between the confronting faces of shank 13 and the tubular strength member 50.

The socket 11 (see especially FIG. 3 and FIG. 4) includes a longitudinally extending inner shell 32 with interior surface defining a longitudinally extending cavity, the shell preferably formed of an insulating plastic material in any well known manner and having at its trailing end an enlarged head 33 of hexagonal cross-section. A pair of oppositely disposed longitudinally extending grooves 34 and 36 respectively are formed in the inner face of the shell 32 and extend from the open trailing end thereof to a point short of the leading end. Groove 34 is of channel-shaped transverse cross-section corresponding in shape to the plug protuberance 18, and the groove 36 is of triangular transverse cross-section corresponding in shape to the plug protuberance 19, to permit sliding engagement between the corresponding grooves and plug protuberances and permitting sliding engagement between the plug and socket only at a predetermined orientation or polarization when the protuberances 18 and 19 register with the grooves 34 and 36. The relative sliding of the plug 10 and socket 11 is a non-shorting sliding in that the contacts of the plug do not touch the contacts of the socket during the sliding.

The grooves 34 and 36 (at their leading end) terminate in and communicate with circumferentially extending channel-shaped grooves as 37 (FIG. 1) which extend approximately 90° clockwise as viewed forwardly from end 33. Also formed in the inner face of the shell 32 in the neighborhood of the head portion 33 (FIG. 4) are a pair of oppositely disposed channel-shaped circumferential grooves 38 which extend clockwise from each of the longitudinal grooves 34 and 36 for approximately 90°. The longitudinal spacing between grooves 37 and 38 is equal to the longitudinal spacing between the plug protuberances 18 and 19. Thus, plug 10 may be inserted into socket 11 upon proper polarization, and following the full insertion of the plug within the socket, the plug may be rotated clockwise 90°, as viewed from the open end of the socket, the protuberances 18 and 19 engaging and locking in grooves 37 and 38.

Formed in the inner face of the inner shell 32 are two diametrically opposed longitudinal sets of circumferentially extending channel-shaped recesses 40 disposed between grooves 34 and 36. The center spacing between successive recesses 40 is substantially the same as the spacing between successive plug contact elements 20 or 21, and the recesses 40 of the opposite sets are laterally aligned. Disposed in each of recesses 40 is a contact element 41 formed of a resilient strip of metal. Each contact element 41 includes a curved section 42 having its convex portion directed inwardly towards the axis of shell 32 and provided with a centrally facing protuberance 43 adapted to engage recess 22 formed in the corresponding plug contact element 20 or 21. Radially projecting arm 44 extends from one end of the contact element curved portion 42 through the wall of inner shell 32 and terminates in a circumferentially extending lug 46 substantially superimposed upon the outer wall of inner shell 32. The free end of contact element curved portion 42 is oppositely bent, as at 47, and bears against the base of the corresponding recess 40. The crown of the contact element convex portion 42, as well as the protuberance 43, project inwardly of the inner cylindrical wall of the shell 32 when in normal unstressed condition. The contact elements 20, 21 and 41 may be formed of any suitable conducting material such as brass or copper and are preferably electroplated in accordance with conventional practice with palladium or other suitable metal to provide greater corrosion- and abrasion-resistance and a better electrical contact surface.

The contacts 20 and 21 of the plug do not touch the contacts 41 of the socket during the sliding of the plug into the socket. Thus, as mentioned, the relative sliding of the plug 10 and socket 11 is a non-shorting sliding.

An intermediate cylindrical shell 49 (FIG. 3) is formed of an insulating material such as a plastic material, and may be integrally formed with the inner shell 32 or firmly adhered thereto. Lugs 46 of the contact elements 41 are embedded in the intermediate shell 49 and are connected to insulator covered conductors 75, which are also embedded in the intermediate shell 49 and extend longitudinally in the wall of the shell through the leading end thereof. It should be noted that the insulation covering 75 as well as that covering conductors 23 associated with the plug 10 may be color-coded in the well-known manner. A tubular metal shell 51*a* tightly engages the intermediate shell 49, the leading edge thereof being inwardly inclined to engage the corresponding beveled surface of the intermediate shell, as in FIG. 3.

Figure 7:
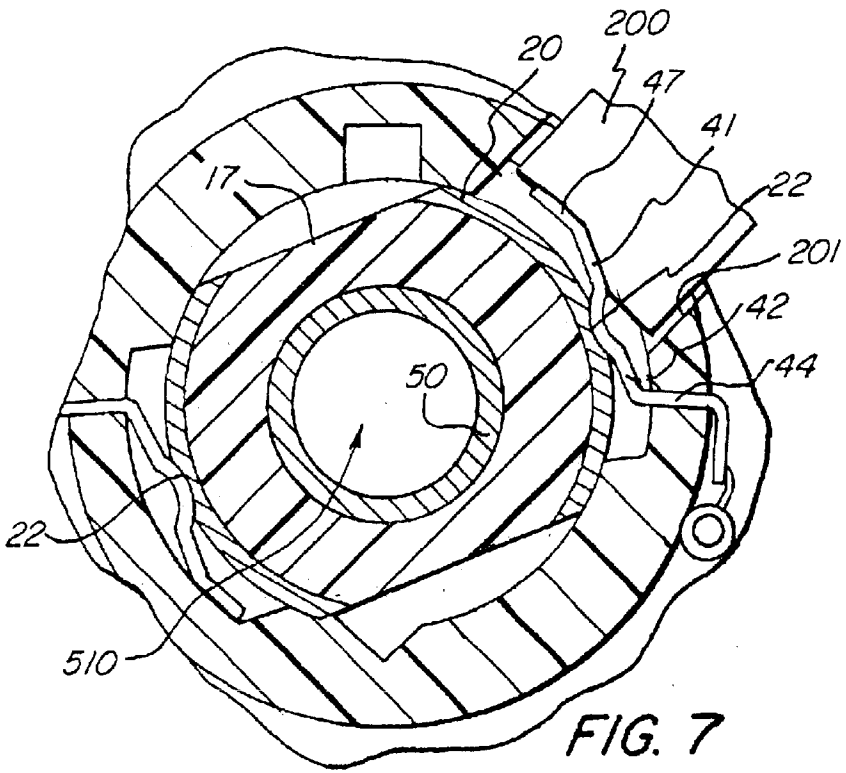
FIGS. 7 is a sectional view of an interconnected plug and socket.

In coupling the plug and socket, plug 10 is aligned with and oriented relative to socket 11 so that the protuberances 18 and 19 engage the longitudinal grooves 34 and 36 respectively. As plug 10 is slid into socket 11, the flats 17 thereof confront the socket contact elements 41, whereas the plug contact elements 20 and 21 do not engage the contact elements 41 but merely slide along the inner surface of the insulating shell 32. In order to effect engagement between the contact plug elements 20 and 21 and the socket contact elements 41, the plug is rotated clockwise, as seen in FIG. 7. In this latter position, the plug and socket are in coupled contact closed position. As plug 10 is rotated relative to socket 11, the plug contact elements are conveyed along the socket contact elements 41 resiliently urging the latter forwardly until the contact recesses 22 are in registry with the contact protuberances 43, in which position the plug and socket are in contact closed position. The reverse procedure is followed in effecting a contact open position and subsequently uncoupling the plug from the socket.

Figure 5:
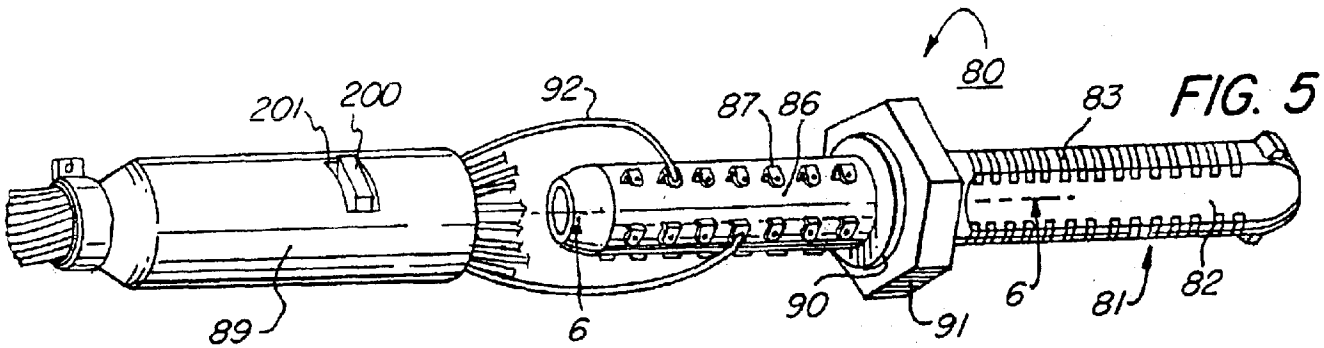
FIG. 5 is an exploded perspective view of a modified form of the invention.
Figure 6:
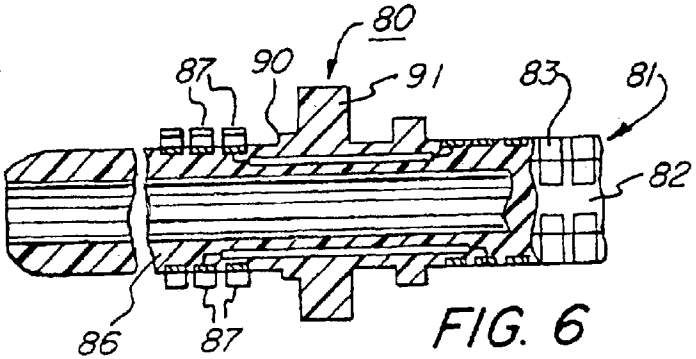
FIG. 6 is a fragmentary sectional view taken along line 6—6 in FIG. 5.

In FIGS. 5 and 6 of the drawing, there is illustrated another embodiment of the present invention differing from that above described primarily in that a contact post 86 is provided on a plug 80 for facilitating connections thereto, it being understood that such expedient may be employed with the socket 11 shown in FIG. 1. In the embodiment shown in FIGS. 5 and 6, plug 80 includes the IC 200 in an opening 201 in a housing 89 for the contact post 86 (an IC that may be instead of or in addition to an IC embedded in the mating socket), and comprises a leading coupling section 81 similar in construction to plug 10 as above described, including a shank 82 carrying the contact elements 83 in the manner earlier described. Coaxial with and projecting rearwardly from the trailing head end of the shank 82 is a tubular post 86, along the length of which is mounted a plurality of longitudinally and circumferentially spaced metal connector ears or lugs 87 provided with arms projecting through the wall of the post 86 into the interior thereof. Each of the contact elements 83 is electrically connected to a respective lug 87 by a corresponding conductor extending along the interior of shank 82 and post 86.

The housing 89 for the contact post 86 is open-ended and tubular and has at least its inner face formed of an insulating material; it is slidable over the contact post 86 with its peripheral wall radially spaced therefrom the leading inner border of the housing 89 separably snugly engaging an annular shoulder 90 formed on the trailing face of the plug head 91. Insulation covered conductors 92 have their ends soldered or otherwise connected to corresponding lugs 87 and extend through the trailing opening of the housing 89 and are connected as desired. Plug 80 may be employed with socket 11 as earlier described or with a socket modified in the manner of plug 80.

Figure 8:
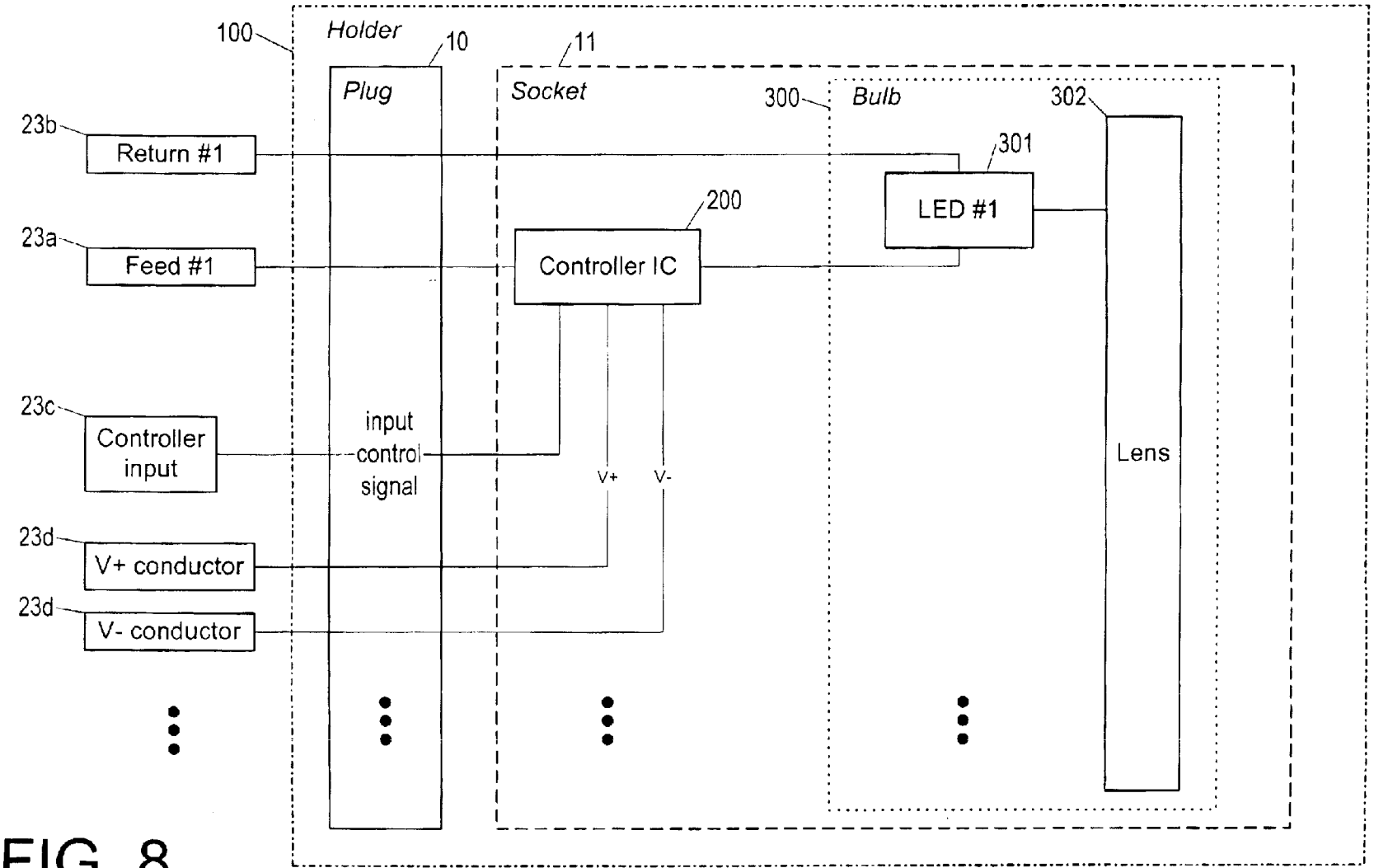
FIG. 8 is a block diagram illustrating the arrangement and interconnection of components of the LED holder of FIG. 1.

Referring now to FIG. 8, the internal wiring and component arrangement of the holder 100 is shown, with the plug 10 providing the feed 23*a* and the return 23*b* for the respective LED 301 in the socket 11, with the controller IC 200 in-line with the feed 23*a*. The controller IC 200 provides typically a variable current-limiting resistance for controlling the intensity of the light provided by the LED 301 in the array of LEDs within the diode bulb 300, with the diode bulb 300 providing the light from the LEDs via the lens 302. The controller IC 200 is provided with power via a pair of power supply conductors 23*d*, one at a first voltage (V+) and the other at a second voltage (V−). The controller IC 200 receives commands (such as to change the current limiting resistance to another value) via a controller input conductor 23*c*. (The power supply conductors 23*d* and the controller input conductor 23*c*, along with the feed 23*a* and return 23*b*, are shown in FIGS. 1–7 as the conductors 23.) As indicated (by the various ellipses), the holder 100 includes a plurality of LEDs 301 and corresponding conductors 23*a—d* and respective in line controller ICs 200.

The conductors 23 can be connected to a typical line source of electrical power, or can instead be connected to a battery source of power so that the LED holder 100 can serve for example as the principal component of a flashlight. Also, instead of including an embedded controller IC 200, the LED holder 100 can include simply in-line current limiting resistors.

Figure 10:
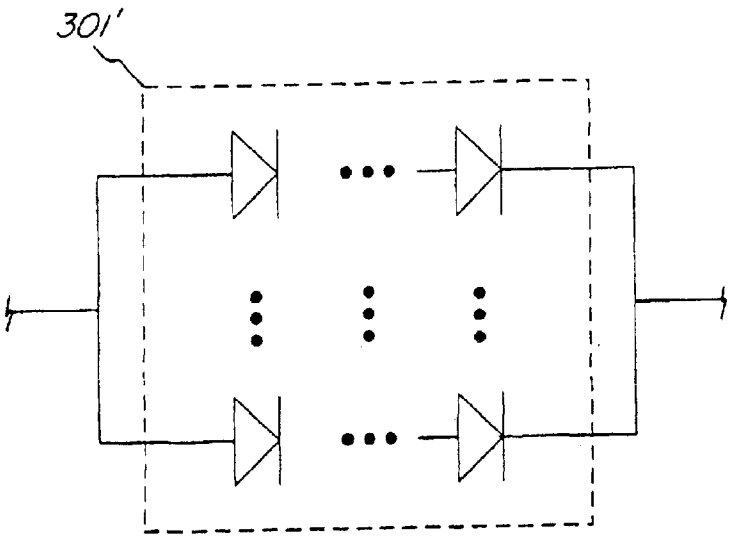
FIG. 10 is a schematic diagram illustrating a series/parallel arrangement of LEDs for use in the LED holder of FIG. 1.
Figure 9:
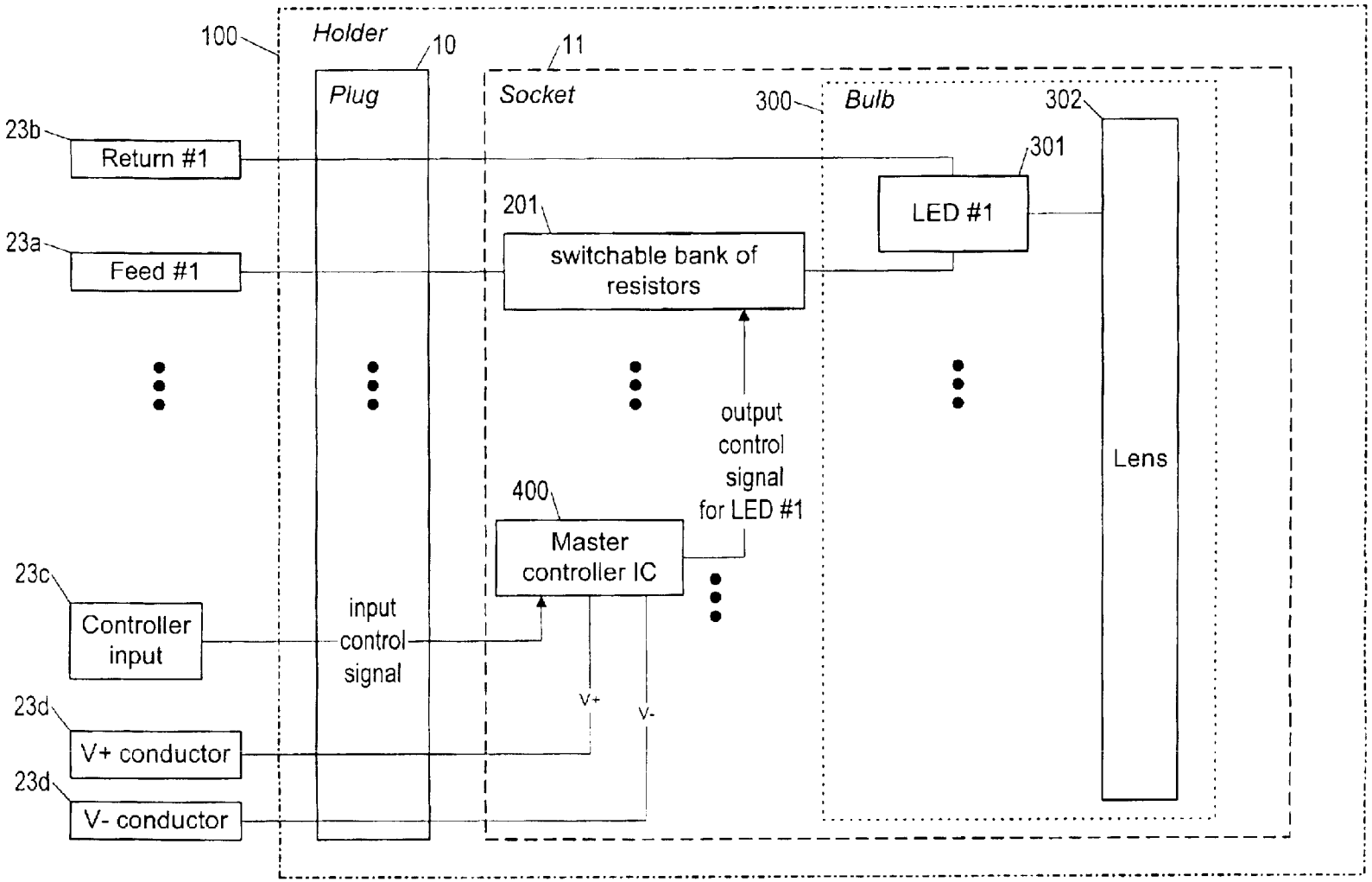
FIG. 9 is a block diagram illustrating an alternative arrangement and alternative interconnection of components of the LED holder of FIG. 1.

Referring now to FIG. 9, in some embodiments, to provide variable current-limiting resistance or for otherwise controlling the LEDs 301, instead of having a controller IC 200 for each LED 301, a single master controller IC 400, specially adapted to the LED holder 100, is included in the socket 11 to operate banks 201 of in-line current limiting resistors so as to include one or more of the resistors in the circuit for the corresponding LED 301. The master controller IC 400 receives as an input control signal a high-level command, such as reduce intensity to low or change color to amber, and provides corresponding respective output signals for the switchable banks 201 of resistors. In a simpler embodiment, instead of providing a different output signal for each switchable bank 201 of resistors, the master controller IC 400 provides a single output control signal that is tapped so as to be provided to each of the switchable banks 201 of resistors. Although the master controller IC 400 and the controller ICs 200 are shown as included in the socket 11, they can also of course be included in the plug 10, which in some applications can be preferable, since in replacing the socket 11 (diode bulb and terminal), the controller ICs 200 or the master controller IC 400 are not replaced. Also, instead of having a bank 201 of resistors for each LED 301, which allows for providing individual control, in applications where individual control is not necessary a single bank of resistors (or even a single resistor) or a smaller number of banks of resistors can be used and two or more LEDs 301 can be connected in parallel to a respective one of the banks of resistors. Also still, as shown in FIG. 10, each of the LEDs 301 of FIGS. 8 and 9 can instead be a series/parallel array 301'.

As mentioned the invention encompasses having the socket 11 serve as a holder not only for LEDs, but for all sources or receivers of radiation. Thus, for example, the socket 11 can serve as a holder for microwave diodes. In such an embodiment, in which microwave diodes are used as either a source or receiver of microwave radiation, in the diode bulb 300 of FIG. 1, the LEDs 301 are replaced by microwave diodes, and the lens 302 is replaced by a parabolic reflector having a pickup dipole at the region of its focus, with the microwave diodes all coupled to the parabolic reflector via microwave feed lines. A microwave diode as used here can be either a source or receiver of microwave radiation in the same way as a diode can be either an LED (source of visible) or a photodiode (receiver of visible). For example, a microwave diode can be a source of microwave energy conveying a signal. In some applications, such as detector applications, a microwave diode receives an AC signal at a microwave frequency and mixes it with a signal from a local oscillator to provide a DC rectified signal. As other examples, a microwave diode can be used as a microwave mixer or as a local oscillator in a radar system. In addition, a microwave diode can be used as an RF source to be modulated in low-power microwave communications (such as e.g. in cellular or ordinary telephony and local area networks). Also, microwave diodes are used in "phased array" radar systems including radar antennas using electronic scanning by rapidly switching microwave diodes mounted on the faces of the reflectors and simultaneously mixing with the received reflected signals.

As another example of the versatility of the invention, the socket 11 can serve as a holder for photocells (which in essence function as LEDs in reverse). In such an embodiment, in the diode bulb 300 of FIG. 1, the LEDs 301 are replaced by photocells.

The invention also encompasses embodiments in which the diodes are coupled not only to ordinary electrical conductors (i.e. direct current or low frequency current, as opposed to radio frequency or higher-frequency electrical currents). For such other coupling, the holder 100 includes, in what is shown here as a vacant cavity 510 (FIG. 2) in the plug 10 and a corresponding aligned vacant cavity 511 (FIG. 3) in the socket 11, radio frequency conductors (coaxial type cabling) or optical conductors (such as optical fiber type conductors) as shown and described in U.S. Pat. No. 3,154,360, entitled MULTI-CONDUCTOR COAXIAL ELECTRICAL CONNECTOR, issued Oct. 27, 1964, and U.S. Pat. No. 6,416,334, entitled COMBINATION MULTICONDUCTOR/OPTICAL FIBER CONNECTOR, issued Jul. 9, 2002, respectively, both hereby incorporated by reference in their entirety. The coupling of the radio frequency or optical conductors from the plug 10 to the socket 11 is as shown and described in the respective above patents, and the conductors are then terminated in the socket 11 either in ICs 200 embedded in the socket 11 (for example for providing power to the ICs or for providing control signals for the ICs), or in the diodes 301 held by the socket 11. Thus, the plug 10 includes in a longitudinally extending center cavity 510, and the socket 11 includes in what would be a corresponding longitudinally extending center cavity 511 (indicated by dashed lines 511*a*) an end of at least one conductor adapted for conveying high frequency signals, such as radio frequency, microwave, or optical, and means for connecting the ends, and the conductor adapted for conveying the high frequency signals in the socket 11 is terminated either in one or more integrated circuits embedded in the socket 11, or in at least one of the diodes 301 301' held by the socket 11.

Figure 11A:
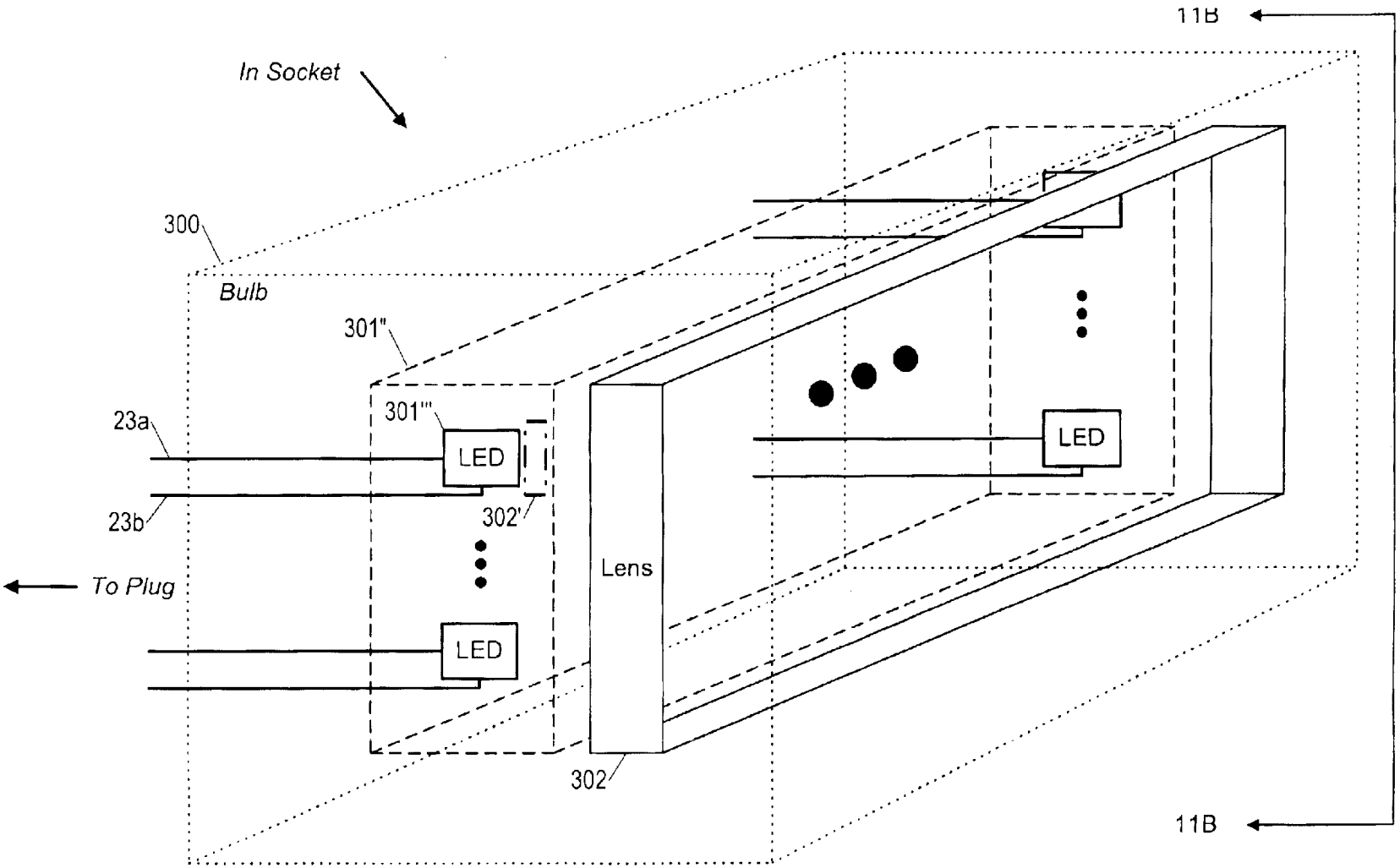
FIGS. 11A and 11B are a schematic diagram of two views of a diode bulb of an LED holder according to the invention, with the diode bulb including an array of diodes.
Figure 11B:
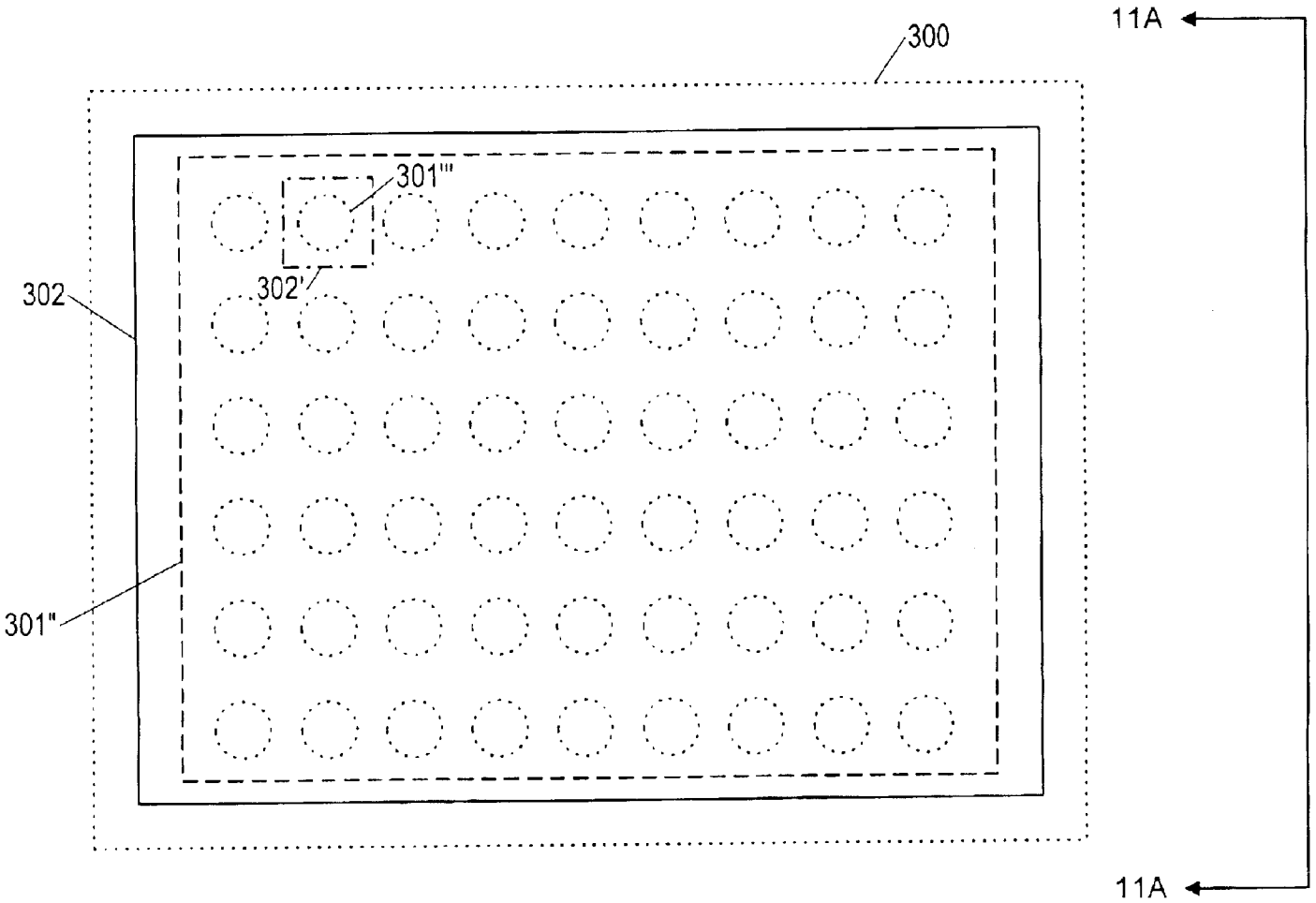

Referring now to FIGS. 11A and 11B, the series/parallel array fixture 301' of FIG. 10 is shown in more detail in case of a purely parallel array 301"(and emphasizing the two-dimensional nature of the array). The diode bulb 300 in the socket 11 (FIG. 9) is shown in FIG. 11 as including the array fixture 301" made up of a two-dimensional array of individual LEDs 301'" each having a feed 23*a* and a return 23*b* leading to the plug 10 (FIG. 9). The feed 23*a* or return 23*b* may also be connected to the switchable bank 201 of resistors also preferably included in the socket 11. The diode bulb 300 may include a single lens 302 for all the LEDs of the array fixture 301", or each individual LED 301'" may have its own lens 302'(shown in dash-dot line). The array fixture 301' preferably includes from 50 to several hundred LEDs, and the LEDs may be arranged in a rectangular array as shown in FIG. 1, or in any other configuration. For example, the LEDs may be arranged in a two-dimensional circular array, or a two-dimensional array in any other shape, or may even be arranged so that the light-emitting (or receiving) surfaces define not a two-dimensional surface but instead a three-dimensional body. The same holds true for the series/parallel array fixture 301' of FIG. 10.

An array fixture 301' 301" can be used not only to provide greater intensity (as an emitter or source of light or other radiation) or greater sensitivity (as a receiver of radiation), but can also be used in other ways. For example, in case of an array of LEDs, to allow for changing the overall color of the light provided by the array, the array can include different LEDs producing light of different color and the intensity of the different colored light from the different LEDs can be varied. As another example, in case of an array of microwave diodes, the array can be configured as a phased array (described above), or, in case of laser diodes, can be configured as a high-power laser.

It is to be understood that the above-described arrangements are only illustrative of the application of the principles of the present invention. In particular, as explained above, the invention is of use not only as a holder for LEDs, but as a holder for diodes serving as a source or receiver for any king of visible or invisible radiation. Numerous modifications and alternative arrangements to those described above may be devised by those skilled in the art without departing from the scope of the present invention, and the appended claims are intended to cover such modifications and arrangements.

What is claimed is:

1. A holder (100), comprising a plug (10) and socket (11), wherein the socket (11) includes a diode (301 301' 301" 301'") able to serve as a source or receiver of visible or invisible radiation, wherein the socket (11) has an elongated longitudinally extending cavity formed therein as the inner surface of a shell (32) and includes a plurality of longitudinally spaced mutually insulated first contact elements (41) disposed within said cavity, wherein the plug (10) slidably registers with said cavity between advanced and retracted positions and has a leading end directed toward the base of said cavity, wherein the plug (10) includes a plurality of longitudinally spaced, mutually insulated second contact elements (20 21 83) disposed along said plug (10), and wherein the holder (100) includes means (18 19 34 36) maintaining a predetermined angular orientation between said plug (10) and socket (11) during relative sliding thereof and permitting relative rotation thereof at said plug advanced position, said first contact elements (41) and second contact elements (20 21 83) being out of engagement at said predetermined angular orientation and in engagement upon rotation in a single predetermined sense from said predetermined angular orientation to a closed contact position.

2. The holder of claim 1, wherein the diode (301 301' 301" 301'") is a light-emitting diode (LED).

3. The holder of claim 1, wherein the diode (301 301' 301" 301'") is a laser diode.

4. The holder of claim 1, wherein the diode (301 301' 301" 301'") is a photocell diode.

5. The holder of claim 1, wherein the diode (301 301' 301" 301'") is a microwave diode.

6. The holder (100) of claim 1, wherein the holder (100) includes a controller (200 400) for controlling current to the diode (301 301' 301" 301'").

7. The holder (100) of claim 6, wherein the controller (200 400) is a resistor.

8. The holder (100) of claim 6, wherein the controller (200 400) is an integrated circuit.

9. The holder (100) of claim 6, wherein the controller (200 400) controls a switchable bank (201) of resistors.

10. The holder (100) of claim 6, wherein socket (100) includes a plurality of diodes (301 301' 301" 301'"), and wherein the controller (400) controls a plurality of banks (201) of resistors, each for limiting current to a respective diode (301) or a series/parallel array (301' 301") of diodes.

11. The holder (100) of claim 6, wherein the diode (301 301' 301" 301'") is provided as a series/parallel array (301' 301") of individual diodes (301'").

12. The holder (100) of claim 11, wherein the array (301' 301") of diodes (301'") is provided as either a two-dimensional array or a three-dimensional array.

13. The holder (100) of claim 11, wherein the array (301' 301") of diodes (301'") is provided as either a purely series array or a purely parallel array or a series/parallel array.

14. The holder (100) of claim 11, wherein the output of the individual diodes (301'") is in phased relation, using for the individual diodes (301'") either diode sources or diode receivers of radiation.

15. The holder (100) of claim 1, including a plurality of longitudinally aligned sets of said longitudinally spaced second contact elements (20 21 83) and a corresponding plurality of longitudinally aligned sets of said first longitudinally spaced contact elements (41) wherein the peripheries of said sets of second contact elements (20 21 83) are of arcuate configuration extending circumferentially about the plug (10) for less than 360° and in a straight line, lengthwise of the holder (100).

16. The holder (100) of claim 1, wherein said socket (11) includes a well portion-defined by a cylindrical wall, the inner surface thereof having longitudinally spaced recesses (40) formed therein, said first contact elements (41) being located in said recesses (40) and normally projecting above the upper edges thereof and being resiliently inwardly urged by said second contact elements (20 21 83) during engagement therewith, and including lugs connected to said first contact elements (41) and projecting through said cylindrical wall.

17. The holder (100) of claim 1, wherein said orienting means (18 19 34 36) is defined by at least one longitudinally extending groove (34 36) formed in one of said holder members (10 11) and at least one slidably engaging protuberance (18 19) mounted on the other of said members (10 11).

18. The holder (100) of claim 1, wherein the plug (10) and socket (11) each include in a respective longitudinally extending center cavity (510 511) an end of at least one conductor adapted for conveying high frequency signals and means for connecting the ends.

19. The holder (100) of claim 18, wherein the conductor adapted for conveying the high frequency signals in the socket (11) is terminated in an integrated circuit embedded in the socket (11).

20. The holder (100) of claim 18, wherein the conductor adapted for conveying the high frequency signals in the socket (11) is terminated in at least one of the diodes (301 301') held by the socket (11).

* * * * *

UNITED STATES PATENT AND TRADEMARK OFFICE

CERTIFICATE OF CORRECTION

PATENT NO. : 6,764,347 B1
DATED : July 20, 2004
INVENTOR(S) : Paul J. Plishner

It is certified that error appears in the above-identified patent and that said Letters Patent is hereby corrected as shown below:

Title page,
Item [56], References Cited, U.S. PATENT DOCUMENTS, "6,416,334, Plishner", delete "7/2002" and substitute -- 8/2002 --.

Column 4,
Line 25, delete "look" and substitute -- 100 --.
Line 67, change "The." to -- The --.

Column 5,
Line 4, change "17;" to -- 17. --

Signed and Sealed this

Twelfth Day of April, 2005

JON W. DUDAS
*Director of the United States Patent and Trademark Office*